United States Patent [19]

Lewis, Jr. et al.

[11] Patent Number: 5,073,988

[45] Date of Patent: Dec. 24, 1991

[54] SLEEVE-GLOVE ATTACHMENT ASSEMBLY FOR PROTECTIVE COVERALLS

[75] Inventors: Milton A. Lewis, Jr., Richmond, Va.; Jeffrey S. Mason, Covington, Ind.; Carson B. Swinford, Danville, Ill.; Timothy R. Wisemann, Sr., Richmond, Va.

[73] Assignee: E. I. DuPont de Nemours and Company, Wilmington, Del.; Steel Grip, Inc., Danville, Ill.

[21] Appl. No.: 677,984

[22] Filed: Mar. 29, 1991

Related U.S. Application Data

[63] Continuation of Ser. No. 414,486, Sep. 29, 1989, abandoned.

[51] Int. Cl.[5] ..... A41D 19/00; A41B 7/02

[52] U.S. Cl. ..... 2/162; 2/123; 2/270

[58] Field of Search ..... 2/162, 161 R, 2.1 R, 2/2.1 A, 270, 16, 81, DIG. 6, 270, 123

[56] References Cited

U.S. PATENT DOCUMENTS

| | | | |
|---|---|---|---|
| 1,626,136 | 4/1927 | Hart | 2/79 |
| 1,642,670 | 9/1927 | Davis et al. | 2/270 |
| 1,795,775 | 3/1931 | Hart | 2/79 |
| 1,896,183 | 2/1933 | Manson | 2/79 |
| 2,421,848 | 6/1947 | Philipps | 2/270 |
| 2,516,241 | 7/1950 | Mulheran | 2/159 |
| 2,994,089 | 8/1961 | Ferguson, Jr. et al. | 2/81 |
| 3,496,572 | 2/1970 | Herzig | 2/2 |
| 3,889,297 | 6/1975 | Jarboe et al. | 2/16 |
| 4,242,769 | 1/1981 | Rayfield et al. | 9/330 |
| 4,270,228 | 6/1981 | Gaiser | 2/158 |
| 4,667,344 | 5/1987 | Cooper, III | 2/79 |
| 4,733,412 | 3/1988 | Campbell | 2/161 A |
| 4,742,579 | 5/1988 | Dunford | 2/160 |
| 4,868,927 | 9/1989 | Bourdeau et al. | 2/161 A |

FOREIGN PATENT DOCUMENTS

| | | | |
|---|---|---|---|
| 674638 | 4/1939 | Fed. Rep. of Germany | 2/270 |
| 1283334 | 12/1960 | France | 2/270 |
| 105214 | 4/1917 | United Kingdom | 2/270 |
| 866848 | 5/1961 | United Kingdom . | |

*Primary Examiner*—Werner H. Schroeder
*Assistant Examiner*—Sara M. Current

[57] ABSTRACT

In accordance with the invention, a sleeve-glove attachment assembly is provided for protective coveralls for use in protecting the wearer in a hazardous environment. The coveralls include torso, leg and sleeve portions with each sleeve having a forearm portion terminating at a wrist opening. The coveralls also include a glove with a cuff. The sleeve-glove attachment assembly includes an inner sleeve attached at an attachment location on the interior of the forearm of the sleeve which extends toward and terminates adjacent the wrist opening. Complementary hook and loop fastening tapes on the outside of the inner sleeve and the inside of the cuff serve to attach the glove to the inner sleeve. A slit-like opening in the sleeve of the coveralls extends into the sleeve from the wrist opening and terminates proximate the attachment location of the inner liner. A zipper is provided for closing the slit-like opening. A closable slit-like cuff opening is also provided in said cuff of said glove. The sleeve is dimensioned so that the sleeve receives the closed cuff of the glove attached to the inner sleeve and snugly contacts the cuff when the zipper closes the slit-like opening.

4 Claims, 4 Drawing Sheets

SLEEVE-GLOVE ATTACHMENT ASSEMBLY FOR PROTECTIVE COVERALLS

The application is a continuation of Ser. No. 07/414,486 filed on Sept. 29, 1989, now abandoned.

BACKGROUND OF THE INVENTION

The present invention relates to garments for providing protection to the wearer in a hazardous environment and more particularly relates to a sleeve-glove attachment assembly for protective coveralls for the attachment of a glove to a sleeve.

Various types of protective coveralls are known for use in protecting the wearer of the coveralls from hazards including flame, hot and/or corrosive chemicals, molten metals, and the like. One such type of coveralls includes a one-piece suit for the body, arms and legs and a separate, removable headgear is worn together with the one-piece suit. Protective gloves are typically also worn with the suit.

The coveralls generally have a laminated construction with a durable, usually waterproof, outer shell which is impervious to the hazards to be encountered and a liner which increases the protection against high temperature conditions and may also include additional barrier layers. Gloves are sometimes fabricated from the same fabrics as the suits and can afford similar protection to the hands that is provided to the body. However, there is risk of injury in known suits at the wrists, arms and hands due to the possibility of leakage at the connection between the sleeves and the gloves.

SUMMARY OF THE INVENTION

In accordance with the invention a sleeve-glove attachment assembly is provided for protective coveralls for use in protecting the wearer in a hazardous environment. The coveralls include torso, leg and sleeve portions with each sleeve having a forearm portion terminating at a wrist opening. The coveralls also include a glove with a cuff. The sleeve-glove attachment assembly includes an inner sleeve attached at an attachment location on the interior of the forearm of the sleeve which extends toward and terminates adjacent the wrist opening. Complementary hook and loop fastening tapes on the outside of the inner sleeve and the inside of the cuff serve to attache the glove to the inner sleeve. A slit-like sleeve opening in the sleeve of the coveralls extends into the sleeve from the wrist opening nad terminates proximate the attachment location of the inner sleeve. A zipper is provided for closing the slit-like sleeve opening. A closable slit-like cuff opening is provided in said cuff of sad glove. The sleeve is dimensioned so that the sleeve receives the closed cuff of the glove attached to the inner sleeve and snugly contacts the cuff when the zipper closes the slit-like opening.

In accordance with a preferred form of the present invention, the sleeve-glove attachment assembly further includes an elongate flap attached to the sleeve along and adjacent the zipper on one side of the opening and which is dimensioned to cover the slit-like opening and zipper. Complementary hook and loop fastening tapes are provided on the underside of the flap and the exterior of the sleeve to secure the flap covering the zipper.

In accordance with anotehr preferred form of the present invention, the coveralls include a strap having one end attached to the lower area of the flap covering the zipper and extending along the lower edge of the sleeve at least partially around the sleeve. The strap is attachabel at differing locations proximate to its other end to adjust the size of the wrist opening at the sleeve.

BRIEF DESCRIPTION OF THE DRAWINGS

The invention and its advantages may be understood by reference to the following detailed description when read in conjunction with the accompanying drawings in which.

DETAILED DESCRIPTION

Figure 1:
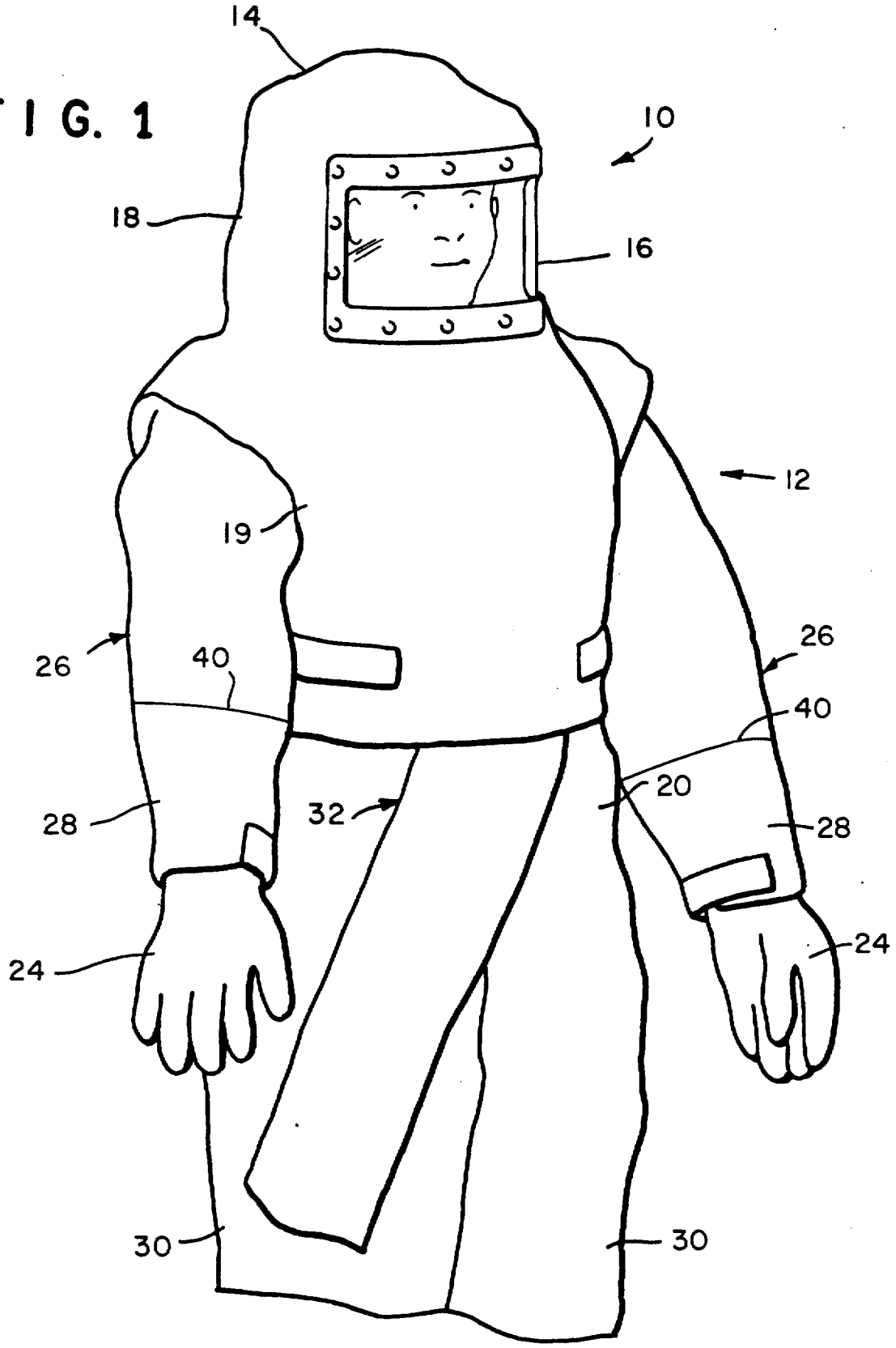
FIG. 1 is a somewhat diagrammaticla perspective view of coveralls incomporating a preferred sleeve-glove attachment assembly in accordance with the present invention.

Referring now to the drawings in which like reference characters designate like or corresponding parts throughout the several views, there is shown in FIG. 1 protective coveralls 10 embodying a preferred from of the sleeve-glove attachment assembly in accordance with the present invention. The protective coveralls include a one-piece main suit 12 and a removable headgear 14. THe headgear 14 includes a viewing lens 16 and a downwardly draping hood 18 for covering the head of the wearer of the coveralls 10 and covering the upper areas of the main suit 12.

The coveralls 10 depicted are intended to represent coveralls which have any of a variety of laminated constructions for protection against hazards including steam, flame, and hot and or corrosive chemicals which include a durable, usually liquid impervious outer shell and a thermal insulative inner liner which may include other barrier layers. The laminated construction is employed for most portions of the coveralls although the unlined shell may comprise portions of the suit which are not in direct contact with the body such as the hood bib 19. A suitable shell for some applications is a woven aramid fabric such as a fabric woven from poly(-paraphenylene terephthalamide) which has been laminated to a liquid impervious layer such as an aluminum film-poly(ethylene terephthalate) film laminate. A suitable liner is a multilayer laminate including at least a layer of woven poly(metaphenylene isophthalamide) and a nonwoven layer such as one or more layers of spun-laced fabric of poly(paraphenylene terephthalamide).

Referring still to FIG. 1, the main suit 12 includes a torso portion 20 including shoulder areas (not shown) and neck opening (not shown). Sleeves 26, with the forearm portion being designated by the number 28, are connected to the one-piece main suit 12. As will be explained in detail hereinafter, the gloves 24 are attachable to the forearm portion 28 of each of the sleeves 26. Leg portions 30 are attached to the torso. A main closure 32 is provided in the main suit 12 for providing access into the suit.

Figure 2:
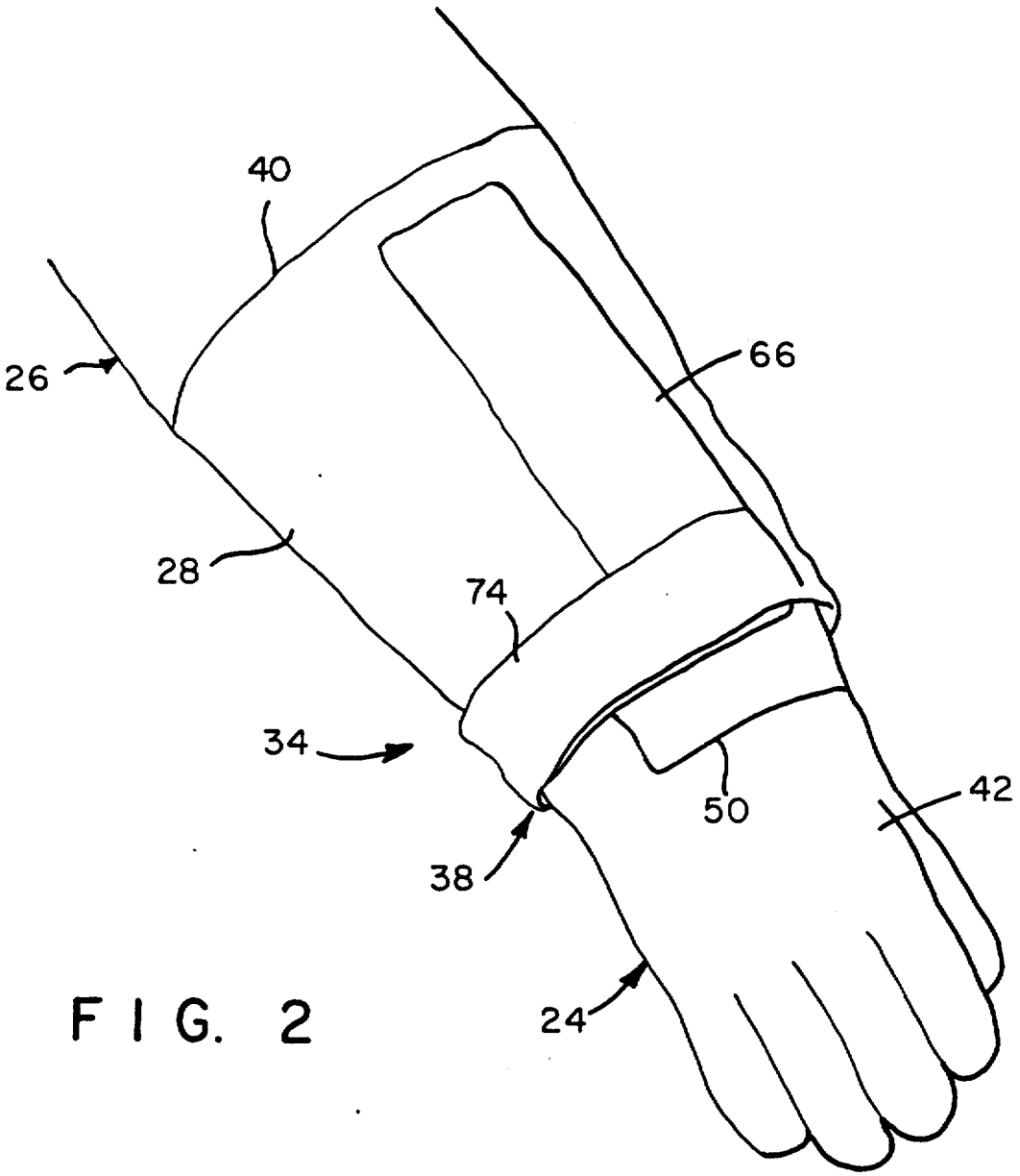
FIG. 2 is an enlarged view of a portion of the sleeve and glove of the coveralls of FIG. 1 illustrating the sleeve-glove attachment assembly fully closed.
Figure 3:
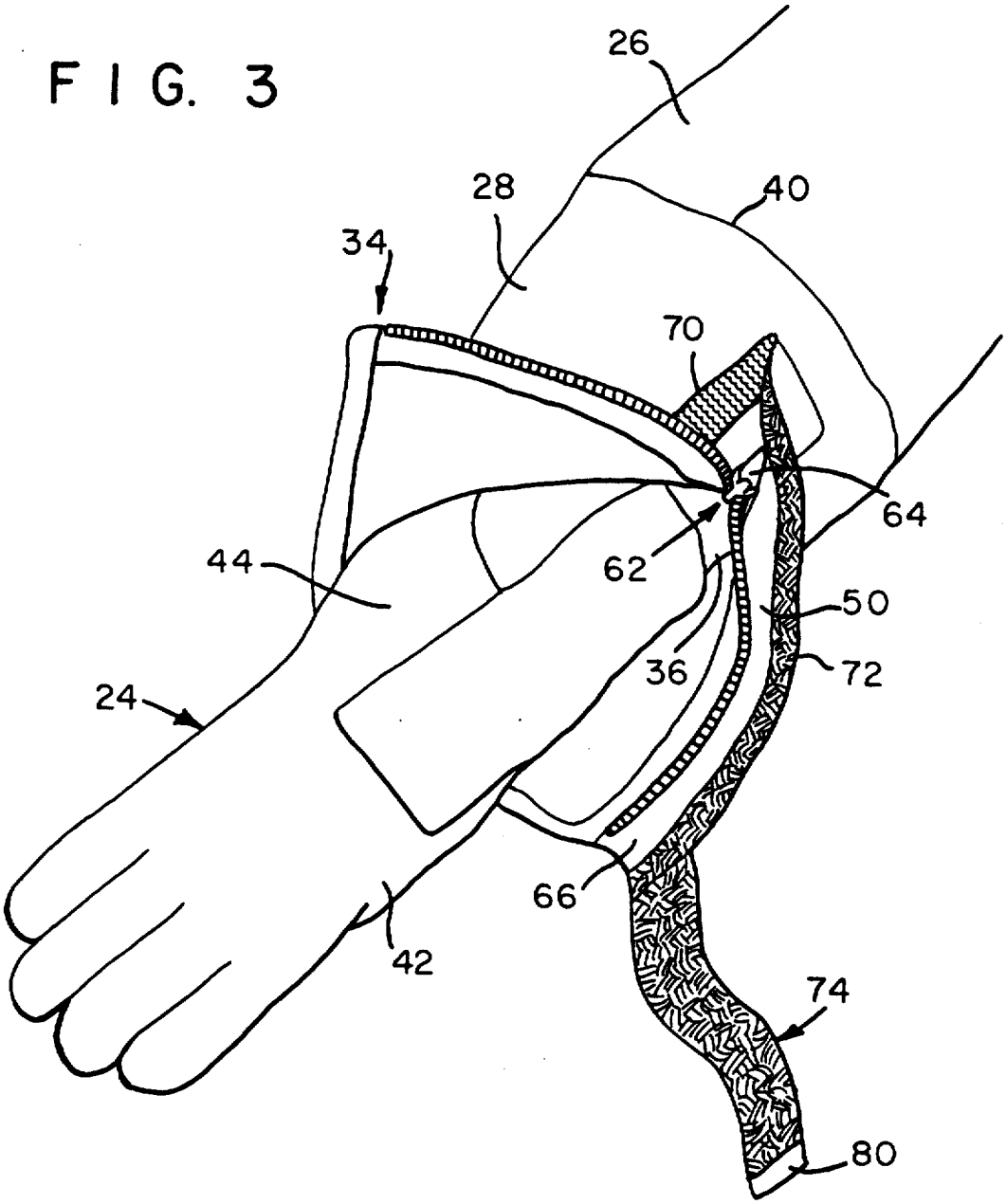
FIG. 3 is a view as in FIG. 2 with the sleeve-glove attachment assembly partially open.
Figure 4:
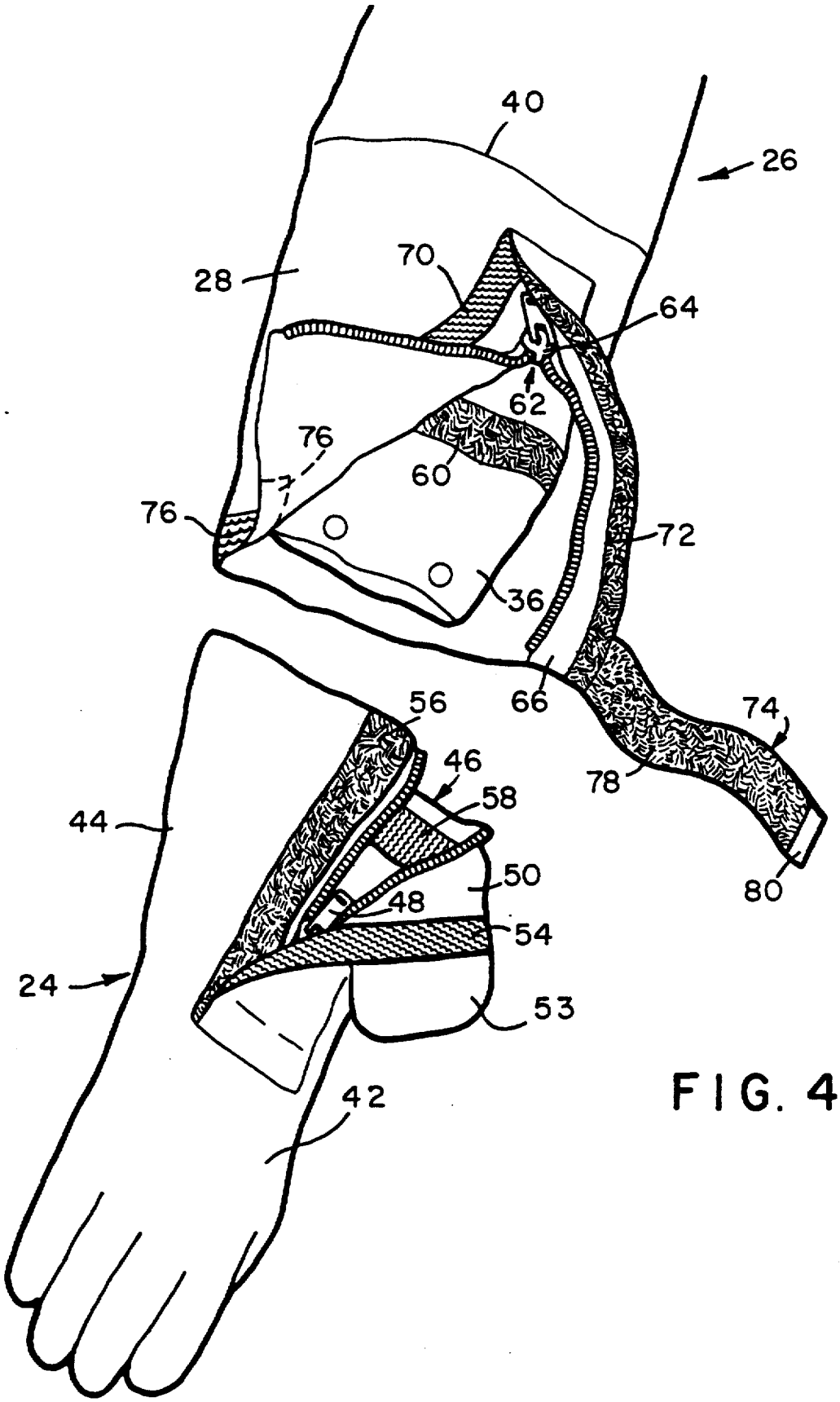
FIG. 4 is an enlarged view of a portion of the sleeve and glove of the coveralls of FIG. 1 illustrating the sleeve-glove attachment assembly fully open and the glove detached from the sleeve.

Referring now to FIGS. 2, 3, and 4, a preferred embodiment of a sleeve-glove attachment assembly 34 in accordance with the invention is illustrated. The illustrated assembly is for the right sleeve and glove of the coveralls but it should be understood that a sleeve-glove assembly for the left side can be a mirror image of the right side.

As shown most clearly in FIG. 4, an inner sleeve 36 is attached to the interior of the forearm 28 of the sleeve 26 and extends toward the wrist opening 38 (see FIG. 2) of the sleeve 26. The inner sleeve 36 can be attached by appropriate means such as sewing to the interior of the sleeve 26 and preferably has a length so that it is generally coextensive with the sleeve 26 and thus is not visible from the exterior of the suit in use. A preferred length for the sleeve is between about 25 cm 35 cm. The preferred location for attachment is on the forearm below the position occupied by the wearer's elbow with the location of attachment in the embodiment depicted being indicated by stitch line 40. The stitch line 40 should be below and spaced-apart from the elbow so that the inner sleeve 36 does not interfere with the bending of the sleeve 26 at the elbow.

The coveralls depicted are intended to represent coveralls in which the inner lining (not shown) of the main suit 12 resembles the main suit and is provided in the torso portion, the leg portions and the sleeve portions. Thus, because the inner sleeve 36 is within the forearm portion of the sleeve, the lining extends downwardly within the inner sleeve. The outer shell fabric forming the sleeve of the coveralls is preferably left unlined from said attachment point to said wrist opening 38 since lining generally would increase the weight and bulk of the suit but confer little additional protection.

Referring still to FIG. 4, a glove 24 embodying portions of the sleeve-glove attachment assembly 34 is illustrated. The glove 24 has a hand portion 42 with palm, thumb, and finger portions for accommodating the hand of the wearer and an attached cuff 44 which extends from the hand portion 42 over the wearer's wrist and partially covers the forearm of the wearer. The cuff 44 is suitably dimensioned so that it can receive the inner sleeve 36 of the suit 12 in use. A slit-like cuff opening 46 is provided in the cuff 44 for opening the cuff and facilitating placement of the cuff 44 about the inner sleeve 36. In the preferred embodiment depicted, a zipper 48 is employed for closing the slit-like opening 46. In addition, an elongate flap 50 is provided which is attached to the cuff along and adjacent the zipper on one side of the slit-like opening and having a length at least as long as the opening and a width sufficient to cover the zipper 48 and provide an overlapping portion which overlaps the cuff on the opposite side of the opening. Complementary hook and loop pile fastening tapes, 54 and 56, respectively, are provided on the underside of the overlapping portion (hook pile tape 54) and the exterior of the cuff (loop pile tape 56) to secure the flap 50 in a position covering the zipper. Suitable hook and loop pile fastening tapes are sold under the trademark VELCRO®. In order to facilitate disengagement of the hook and loop pile tapes to expose the zipper, a pull tab 53 is provided on the lower edge of the elongate flap 50.

As may be seen in FIG. 4, the cuff 44 of the glove 24 is attachable to the inner sleeve 36 to secure the glove to the coveralls 10. In the preferred embodiment, this is accomplished by means of hook pile tape 58 attached to the inside of the cuff 44 and complementary loop pile fastening tape 60 on the exterior of the inner sleeve 36. FIG. 3 shows the cuff 44 attached to the inner sleeve 36 with the cuff in the closed configuration.

Referring to FIG. 3, the forearm 28 of the sleeve 26 is provided with a sleeve slit-like opening 62 to provide access for the placement of the cuff 44 in position for attachment on the inner sleeve 36. A zipper 64 is provided for the slit-like sleeve opening 62 to close the opening 62 once the cuff 44 is in position on the inner sleeve 36. Preferably, the sleeve opening 62 has a length between about 2 cm and about 10 cm shorter than the inner sleeve 36. An elongate flap 66 is attached to the forearm 28 of sleeve 26 along and adjacent the zipper 64 on one side of the opening with the flap 66 having a length at least as long as the opening and a width sufficient to cover the zipper 64 and provide an overlapping portion which overlaps the forearm 28 of the sleeve 26 on the opposite side of the opening 62. Preferably, the flap 66 has a width between about 5 and about 10 cm. Complementary hook and loop pile fastening tapes, 70 and 72, respectively, are provided on the exterior of the forearm 28 of the sleeve 26 and on the underside of the overlapping portion of the flap 66 to secure the flap covering the zipper. The forearm area 28 of the sleeve 26 is dimensioned at the wrist opening 38 so that when the zipper closes the slit-like opening 62, the forearm area 28 of the sleeve 26 receives the cuff 44 of the glove 24 and snugly contacts the glove cuff 44 at the wrist opening 38.

Referring still to FIGS. 2, 3 and 4, a strap 74 is attached to the lower portion of the edge of the flap 66 and extends along the lower edge of the sleeve. The strap 74 has a length sufficient to extend at least partially around the sleeve. A hook tape 76, a portion of which is shown in FIG. 4, is positioned at a location spaced apart from the slit-like opening 62. In the preferred embodiment, loop pile tape 78 is provided on most of the strap 74 so that it can be placed on and secured on the hook pile tape 76 at a number of differenct positions. Due to the spacing between the hook tape 76 and the sleeve opening 62, the placement of the strap 74 on the hook tape 76 can thereby be used to provide adjustment of the wrist opening 38. To facilitate the easy removal of the strap 74 and disengagement of the loop pile tape 78 from the hook tape 76, a pull tab 80 is provided by having the strap 74 extend a short distance past the end of the loop pile tape 78.

In use, FIGS. 2–4 illustrate the attachment of the glove 24 to the forearm 28 of the sleeve 26 in reverse order. The wearer would have main suit 12 on with the slit-like opening 62 of the sleeve in a fully open position as shown in FIG. 4 and with the slit-like opening 46 in the glove 24 similarly open. Pull tab 80 on the strap 74 and the pull tab 53 on the glove can be used to facilitate opening the hook and loop pile tapes to expose the zippers 64 and 48 for opening. The glove is placed over the wearer's hand and the cuff 44 of the glove 24 is then pulled over the inner sleeve 36 and is secured by means of the hook pile tape 58 on the cuff 44 and the loop tape 60 on the inner sleeve 36. Once the fastening tapes 58 and 60 are appropriately fastened together, the zipper 48 is used to close the slit-like opening 46 in the cuff 44 and the flap 50 is moved to its position over the zipper 48 and where it is secured by means of hook pile tape 54 and loop pile tape 56. This configuration is shown in FIG. 3.

The wearer then closes the sleeve slit-like opening 62 by means of the zipper 64 and then positions the elongate flap 66 over the zipper and secures by means of hook pile tape 70 and loop pile tape 72. To insure snugness between the forearm area 28 of the sleeve 26 and the cuff 44, the strap 74 is used to adjust the size of the wrist opening 38 so that the sleeve is appropriately tightened about the cuff 44. This fully closed configuration is shown in FIG. 2.

The sleeve-glove attachment assembly in accordance with the present invention provided secure attachment of the gloves to the sleeves of protective coveralls and effectively provides as seal against leakage at the connection between the glove and the sleeve. In addition, the sleeve glove attachment assembly is easy to use and the wearer can easily attach and detach the gloves to the sleeves without assistance from others.

While a preferred embodiment has been shown and described in the foregoing detailed description, it will be understood that the invention is capable of numerous modifications, rearrangements and substitution of parts without departing from the spirit of the invention as set forth in the appended claims.

We claim:

1. A sleeve-glove attachment assembly in combination with protective coveralls for providing protection to a wearer of the coveralls in a hazardous environment, said coveralls having a torso portion, two leg portions and two sleeve portions each including a forearm portion terminating at a wrist opening, said sleeve portions being adapted to attachably receive a glove with a cuff, the sleeve-glove attachment assembly comprising:

a separate inner sleeve attached at an attachment location on the interior of the forearm portion of said sleeve portions and terminating adjacent said wrist opening;

complementary hook and loop fastening tapes on the outside of said inner sleeve and the inside of said cuff to attach said glove to said inner sleeve;

a slit-like sleeve opening in said sleeve portions extending into said sleeve portions from said wrist opening and terminating proximate said attachment location of said inner sleeve;

a sleeve zipper for closing said slit-like sleeve opening in said sleeve portions;

an elongate sleeve flap attached to said sleeve portions along and adjacent said sleeve zipper on one side of said sleeve opening, said sleeve flap having a length at least as long as said sleeve opening and with a width sufficient to cover the sleeve zipper and provide an overlapping portion which overlaps said sleeve portions on the opposite side of the sleeve opening;

complementary hook and loop fastening tapes on the underside of the overlapping portion of said sleeve flap and the exterior of the sleeve portions to secure said sleeve flap covering said sleeve zipper;

a strap having one end attached to the edge of the lower area of said sleeve flap and extending along the lower edge of said sleeve portions and having a length sufficient to extend at least partially around said sleeve portions;

complementary hook and loop fastening tapes on the underside of said flap and the exterior of the sleeve portions to adjust the size of the wrist opening of said sleeve portions;

a slit-like cuff opening in said cuff of said glove;

a cuff zipper for closing said slit-like cuff opening in said cuff;

an elongate cuff flap attached to said cuff along and adjacent said cuff zipper on one side of said cuff opening, said cuff flap having a length at least as long as said cuff opening and a width sufficient to cover the cuff zipper and provide an overlapping portion which overlaps said cuff on the opposite side of the cuff opening; and complementary hook and loop fastening tapes on the underside of the overlapping portion of the cuff flap and the exterior of said cuff to secure said cuff flap covering said cuff zipper;

said sleeve portions being dimensioned so that said sleeve portions receive said cuff of said glove attached to said inner sleeve and snugly contacts said cuff when siad sleeve zipper closes said slit-like sleeve opening.

2. The sleeve-glove attachment assembly of claim 1 wherein said sleeve-flap has a width of between 5 cm and 10 cm.

3. The sleeve-glove attachment assembly of claim 1 wherein said inne sleeve has a length of between 25 cm and 35 cm.

4. The sleeve-glove attachment assembly of claim 2 wherein said slit-like sleeve opening has a length between 2 cm and 10 cm shorter than said inner sleeve.

* * * * *